US006176767B1

(12) United States Patent
Heijkenskjöld

(10) Patent No.: US 6,176,767 B1
(45) Date of Patent: Jan. 23, 2001

(54) DOUBLE FACE ABRADING MACHINE

(75) Inventor: Mats Heijkenskjöld, Lidköping (SE)

(73) Assignee: Lidkoping Machine Tools AB, Lidkoping (SE)

( * ) Notice: Under 35 U.S.C. 154(b), the term of this patent shall be extended for 0 days.

(21) Appl. No.: 09/446,960

(22) PCT Filed: Jul. 3, 1998

(86) PCT No.: PCT/SE98/01312

§ 371 Date: Dec. 30, 1999

§ 102(e) Date: Dec. 30, 1999

(87) PCT Pub. No.: WO99/01255

PCT Pub. Date: Jan. 14, 1999

(30) Foreign Application Priority Data

Jul. 4, 1997 (SE) ..... 9702589

(51) Int. Cl.[7] ..... B24B 7/00

(52) U.S. Cl. ..... 451/262; 451/259; 451/268; 451/269

(58) Field of Search ..... 451/259, 261, 451/262, 268, 269, 270, 271

(56) References Cited

U.S. PATENT DOCUMENTS 2,045,488 6/1936 Oubridge .
4,361,988 * 12/1982 Gramlich ..... 451/269
5,123,218 6/1992 Karlsrud .

FOREIGN PATENT DOCUMENTS 381 111 9/1964 (CH) .
1218853 * 5/1960 (FR) ..... 451/268

* cited by examiner

*Primary Examiner*—Derris H. Banks
(74) *Attorney, Agent, or Firm*—Burns, Doane, Swecker & Mathis, L.L.P.

(57) ABSTRACT

A double face abrading machine for simultaneous removal of material from two plane-parallel surfaces of a work piece, and incorporating a first and a second tool (1, 2) forming between them a machining gap (3), the first tool (1) being attached to a first shaft (5) and the second tool (2) being attached to a second shaft (7), means (11) for rotating at least one of said first and second shafts (5, 7) and displacement means (13, 14) for individual axial displacement of said first and second shafts (5, 7) for varying the axial size and/or position of the machining gap (3), and means provided for feeding work pieces into the machining gap, wherein the first shaft (5) is designed as a tubular shaft, supporting at one end the said first tool (1), which is designed with an opening (1*a*) having a diameter at least corresponding to the diameter of the tubular shaft (5), whereas the second shaft (7) is arranged to extend through the tubular first shaft (5) and through the opening (1*a*) in the first tool, and to project outside the first tool (1), the second shaft (7) outside the tool-carrying first shaft end supporting the said second tool (2), thus that said machining gap (3) is formed between the opposed surfaces of said first and said second tool (1,2).

5 Claims, 1 Drawing Sheet

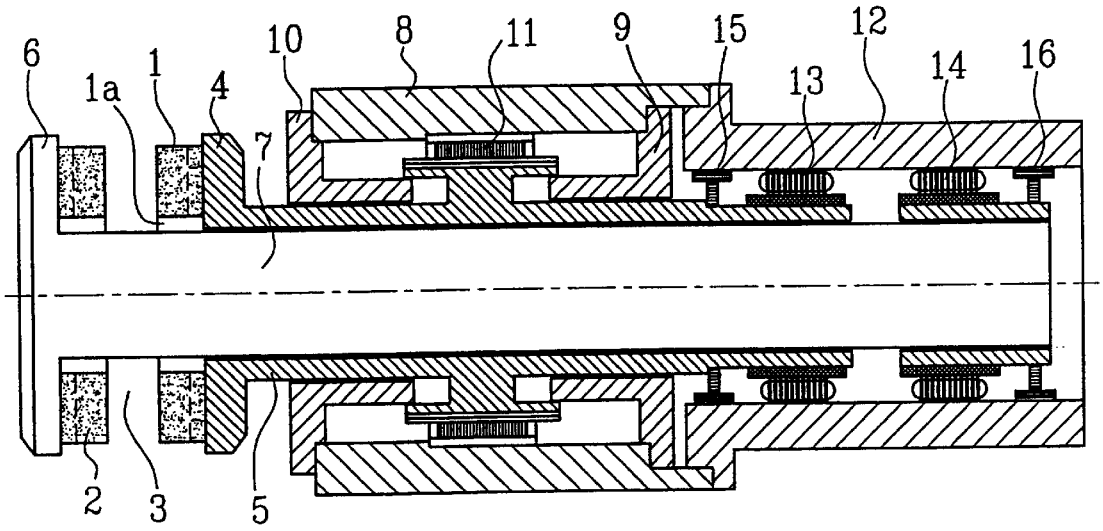
6
1a
1
4
10
8
11
9
15
12
13
14
16
7
2
3
5

DOUBLE FACE ABRADING MACHINE

The present invention relates to a double face abrading machine, i.e. a machine tool designed for simultaneously removing material from two plane-parallel surfaces of a work piece, and particularly a double face grinding machine for grinding the opposed side surfaces of bearing rings and of the type defined in the preamble of the accompanying claim 1.

Double face abraders, such as grinding machines, lapping machines, honing machines and also milling machines, etcetera, which are intended simultaneosuly to machine two plane-parallel side surfaces of a work piece are often designed with two tools mounted on slides on two shafts extending in opposite directions away from the machining gap and which are equipped with separate driving motors. Furthermore there are feeding equipment and driving means for the slides, feeding-in device for the work pieces to be machined and dressing tools e.g. for grinding wheels or the like, etcetera Taken together this means that the earlier machines have been bulky and space-requiring.

The purpose of the present invention is to provide a machine of the type specified hereabove which is very compact, thereby also improving the rigidity and exactness of the machine, and this has been obtained by giving the machine the features defined in the accompanying claim 1.

Hereinafter the invention will be further described with reference to an embodiment schematically shown in the accompanying drawings.

The single FIGURE shows in a longitudinal section schematically the main components of an embodiment of the double face abrading machine according to the invention, in the embodiment designed as a double disc face grinder.

Thus the machine incorporates a first tool 1, here being a first grinding disc, and a second tool 2, here being a second grinding disc, which are arranged in a coaxial and plane-parallel relation to each other and which between them form a machining, or grinding gap 3. The first tool 1 is removably attached to a radial flange 4 provided on a tubular first shaft 5, and has an opening 1*a*, having a diamater, which is at least as big as that of the tubular first shaft, whereas the second tool 2 is removably attached to a radial flange 6 provided on a second shaft 7, which extends through the tubular first shaft 5 and through the opening (1*a*) in the first tool (1) and with its flanged and tool-equipped end projects out of the end of the tubular shaft.

The tubular first shaft 5 is rotatably provided in a housing 8 and supported therein in two radial bearings 9 and 10 (shown in intimated form) which also permit axial displacement of the tubular shaft 5. Although the bearings are intimated as sliding bearings it is of course also possible to use other appropriate types of bearings for supporting the first shaft, such as rolling bearings, magnetic bearings, air bearings etcetera.

In the housing 8 there is also provided a driving motor 11, which is preferably an electric motor and which is adapted to rotate the tubular first shaft 5. In the embodiment schematically illustrated in the drawing, the tubular housing 8 is provided with a tubular extension 12 detachably connected to the rest of the housing 8 and enclosing the rear end of the tubular first shaft 5 and the rear end of the second shaft 7, which projects out from the rear end of the tubular first shaft 5. In the embodiment shown the tubular extension 12 also incorporates drive means 13 for axial displacement of the tubular shaft 5 and drive means 14 for axial displacement of the second shaft 7. These drive means 13, 14, can preferably be formed as linear motors, but other types of prime movers can also be used, such as magnetic bearings, or ball bearings against which the linear motors are allowed to act. It is of course also possible to provide driving means for axial displacement only of one of the tubular shaft and the second shaft, as the purpose of the axial displaceability primarily is to vary the width of the gap between the two tools.

Sensors 15 and 16 are also provided for establishing the current axial positions for the tubular first shaft 5 and for the second shaft 7, respectively.

For feeding a work piece to be treated into the machining gap 3 there are provided any appropriate, earlier known but here not shown feeding device, which feeds the work piece thus that its surfaces to be machined are positioned in a manner in parallel with the opposed, plane parallel surfaces of the first and the second tool 1, 2, in the case illustrated, two grinding discs.

The first tool 1 attached to the tubular first shaft 5, rotates together with this under influence of the driving motor 11, whereas the second shaft 7, positioned inside the tubular first shaft 5 either may be non-rotated, which can be appropriate for some types of machining, or rotated, which is useful in most cases, e.g. if the machine shall be designed as a double disc face grinder. In the case where the second shaft 7 connected to the second tool 2 is rotated, this can either be effected by the drive motor 11, which via a not shown driver, e.g. a driver key transfers its drive force also to the second shaft 7. In this case both the first and the second shaft 5 and 7 will rotate in the same direction and at the same speed. There are also cases where it is appropriate to have a machine wherein the first and second shafts 5 and 7 are driven in opposite directions and/or at different rotational speeds. In such case it is necessary to provide a separate drive motor (not shown) for rotating the second shaft 7. Such an additional drive motor can be arranged in a manner similar to that of the drive motor 11 for the tubular first shaft 5, in the extension 12 of the housing.

In case the machine is designed as a grinder, there is also provided appropriate types of dressing and/or trueing means for giving the grinding discs proper profiles. Such means are not part of the present invention as such, and are therefore not shown in the drawing.

The invention is not limited to the embodiment shown in and described in connection to the accompanying drawings, but modifications and variations are possible within the scope of the accompanying claims. Although the embodiment shown has a stationary housing and a inner shaft rotatably arranged therein, it is thus of course also possible to keep the inner shaft stationary, whereas the housing is allowed to rotate therebout.

What is claimed is:

1. A double face abrading machine for simultaneous removal of material from two plane-parallel surfaces of a work piece, and incorporating a first and a second tool (1, 2) forming between them a machining gap (3), the first tool being attached to a first shaft (5) and which second tool is attached to a second shaft (7), means (11) for rotating at least one of said first and said second shafts (5, 7) and displacement means (13, 14) for individual axial displacement of said first and said second shafts (5, 7) for varying the axial size and/or position of the machining gap (3), and means provided for feeding work pieces into the machining gap, whereby the first shaft (5) is designed as a tubular shaft, which at one en supports the first tool (1), which is designed with an opening (1*a*) having a diameter at least corresponding to the diameter of the tubular shaft (5), whereas the second shaft (7) is arranged to extend through the tubular, first shaft (5) and through the opening (1*a*) in the first tool, and to project outside the first tool (1), which second shaft (7) outside the tool-carrying end of the first shaft (5) supporting the said second tool (2), thus that the machining gap (3) is formed between the opposed surfaces of said first and second tools (1, 2), and where the tubular first shaft (1) is rotatably supported in a housing (8, 12), characterized therein, that the housing (8) is provided with a driving motor (11), which is positioned internally between the inner surface of the housing and the first shaft (5), and which causes the first shaft (5) to rotate.

2. Abrading machine as claimed in claim 1, characterized therein, that the housing (8, 12) is provided with drive means (13, 14) for individually causing the first (5) and second shaft (7) axial displacement relative to each other.

3. An abrading machine as claimed in claim 1, characterized therein, that the second shaft (7) is arranged to be rotated simultaneously with the first shaft (5) by transfer of driving force from the first driving motor (11), which is provided internally in the housing for driving the first shaft.

4. An abrading machine as claimed in claim 1, characterized therein, that the second shaft (7) is arranged to be rotated individually by means of a separate driving motor provided internally in the housing (12).

5. An abrading machine as claimed in claim 1, characterized therein, that the feeding means for individual axial displacement of the first and second shafts (5, 7) are linear motors (13, 14).

* * * * *